United States Patent [19]

Fujie et al.

[11] 4,044,797

[45] Aug. 30, 1977

[54] HEAT TRANSFER PIPE

[75] Inventors: Kunio Fujie, Tokyo; Masaaki Itoh; Tamio Innami, both of Tsuchiura; Hideyuki Kimura, Chiyodamura; Wataru Nakayama, Kashiwa; Takehiko Yanagida, Chiyodamura, all of Japan

[73] Assignee: Hitachi, Ltd., Japan

[21] Appl. No.: 632,155

[22] Filed: Nov. 14, 1975

[30] Foreign Application Priority Data

| | | |
|---|---|---|
| Nov. 25, 1974 | **Japan** | 49-134295 |
| June 4, 1975 | **Japan** | 50-66559 |
| Sept. 22, 1975 | **Japan** | 50-113692 |

[51] Int. Cl.[2] ..... F28F 1/40; F28F 13/02; F28F 13/12

[52] U.S. Cl. ..... 138/38; 138/37; 165/133; 165/179; 165/184

[58] Field of Search ..... 165/133, 179, 184; 138/38, 37

[56] References Cited

U.S. PATENT DOCUMENTS

| | | | |
|---|---|---|---|
| 2,279,548 | 4/1942 | Bailey | 138/38 X |
| 3,088,494 | 5/1963 | Koch et al. | 165/133 X |
| 3,217,799 | 11/1965 | Rodgers | 165/179 |
| 3,273,599 | 9/1966 | Heeren | 165/179 X |
| 3,454,081 | 7/1969 | Kun et al. | 165/133 |
| 3,457,990 | 7/1969 | Theophilos et al. | 165/133 |
| 3,753,364 | 2/1971 | Runyan et al. | 165/133 |
| 3,930,627 | 1/1976 | Miller | 138/38 X |

FOREIGN PATENT DOCUMENTS

| | | | |
|---|---|---|---|
| 225,699 | 12/1924 | United Kingdom | 165/170 |

*Primary Examiner*—Carroll B. Dority, Jr.
*Assistant Examiner*—Sheldon Richter
*Attorney, Agent, or Firm*—Craig & Antonelli

[57] ABSTRACT

A heat transfer pipe for use in a heat exchanger such as air conditioner, freezer and boiler, wherein grooves are formed in the inner wall surface of the pipe, which are by far finer in size than the grooves that have been provided for the purpose of increasing the heat transfer area in general, and slanting relative to the axis of pipe, to thereby improve the heat transfer rate without increasing the pressure loss caused to the fluid flowing through the pipe.

11 Claims, 10 Drawing Figures

HEAT TRANSFER PIPE

FIELD OF THE INVENTION

This invention relates to a heat transfer pipe for use in a heat exchanger such as air conditioner, freezer and boiler.

DESCRIPTION OF THE PRIOR ART

Heat transfer pipes having the purpose of improving the heat transfer rate between the heat transfer pipe and the fluid flowing through the pipe include a pipe provided therein with fins closely adhering to the inner wall thereof and a pipe provided in the inner wall thereof with grooves. Both pipes are intended to increases the heat transfer area in the pipes and expand turbulence of fluid in the pipes by providing fins or grooves, thereby improving the heat transfer rate per unit length of the heat transfer pipes. Accordingly, it is necessary that the height of fins or the depth of grooves should reach or exceed a certain level. With the aforesaid arrangements, the heat transfer pipes have rendered a high level of resistance to the fluid flowing through the pipe, thereby unavoidably receiving a fairly large pressure loss.

Increased pressure loss requires a large pumping power and moreover results in varied condensation and evaporation temperatures and causes hampered performance of the heat exchanger or the operating system as a whole, whereby the adoption of the heat transfer pipes of the type has been hindered.

SUMMARY OF THE INVENTION

An object of the present invention is to provide a heat transfer pipe having a high heat transfer rate. Another object of the present invention is to provide a heat transfer pipe with a low pressure loss. To accomplish the objects described, this invention is characterized in that grooves are formed in the inner wall surface of the pipe, which are by far finer in size than the grooves that have been provided for the purpose of increasing the heat transfer area on the inner wall surface of pipes in general, and slanting at an acute angle relative to the axis of the pipe.

DESCRIPTION OF THE PREFERRED EMBODIMENT

Figure 1:
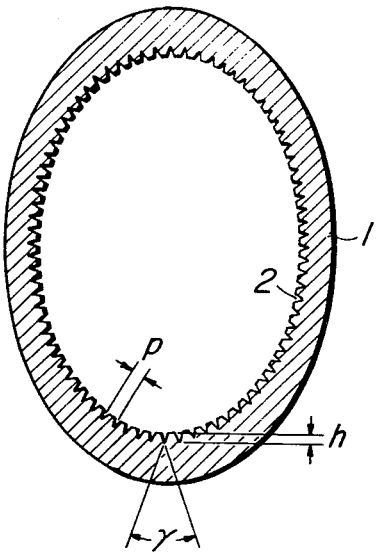
FIG. 1 is an enlarged view of a cross section of a heat transfer having V-shaped grooves pipe according to the present invention, which is sectioned by a plane perpendicular to the grooves.
Figure 2:
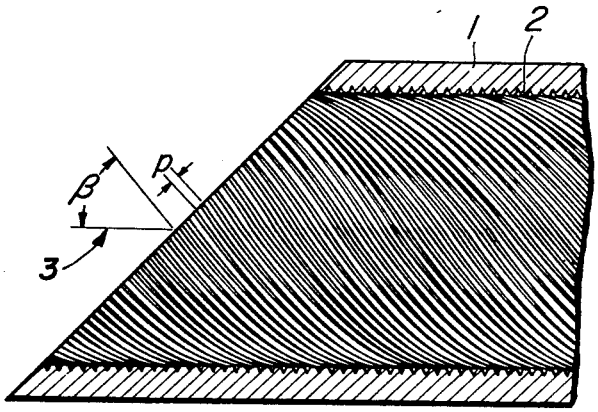
FIG. 2 is an enlarged view of a cross section of a heat transfer pipe according to the present invention, which is sectioned by a plane including the axis of the pipe.

FIG. 1 is an enlarged view of a cross section of a heat transfer pipe according to the present invention, which is sectioned by a plane perpendicular to the groove. FIG. 2 is an enlarged view of a cross section of a heat transfer pipe according to the present invention, which is sectioned by a plane including the axis of the pipe. A multitude of grooves 2 which are V-shaped in section are provided in the inner wall surface of the heat transfer pipe 1. The depth $h$ of grooves 2 from the inner wall surface ranges from 0.02 to 0.2 mm. The interval between a groove and the next groove, i.e., the pitch $p$ ranges from 0.1 to 0.5 mm. The apex angle $\gamma$ ranges from 30° to 90°. Additionally, the grooves 2 are formed in the inner wall surface of the heat transfer pipe 1 in the spiral shape. More specifically, the inclination $\beta$ relative to the axis 3 of the heat transfer pipe 1 is given by:

$$0° < \beta < 90°, 90° < \beta < 180°$$

Figure 3:
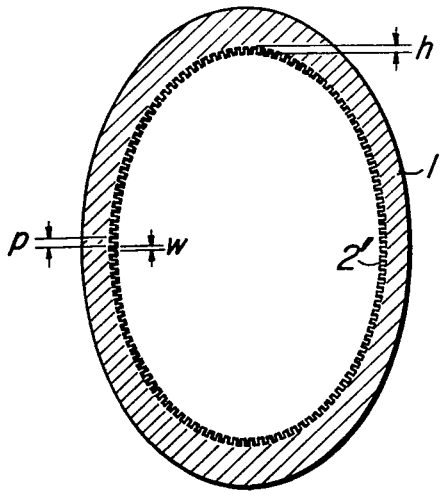
FIG. 3 is an enlarged view of another heat transfer having U-shaped grooves pipe according to the present invention, which is sectioned by a plane perpendicular to the groove.

FIG. 3 is an enlarged view of another heat transfer pipe according to the present invention, which is sectioned by a plane perpendicular to the groove. The grooves 2 are U-shaped in section. The depth $h$, pitch $p$ and the inclination $\beta$ of grooves 2 are identical with that in the preceding embodiment.

Figure 4:
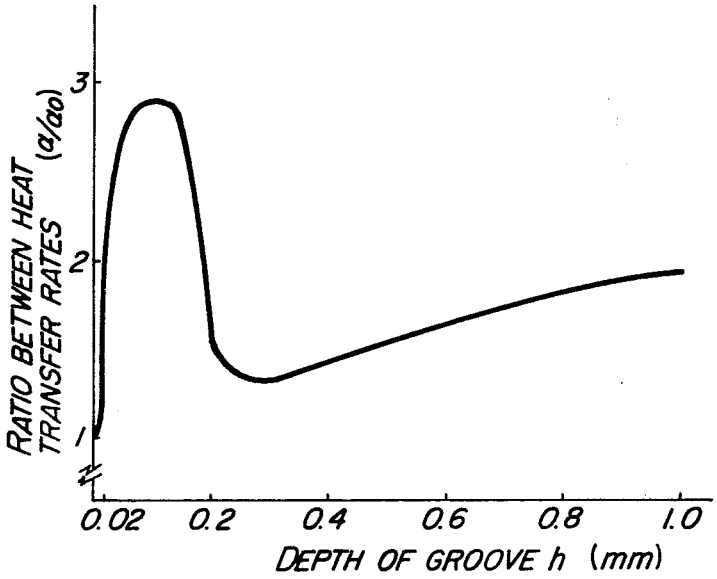
FIG. 4 is a diagram showing the relationship between the depth of groove and the heat transfer rate.

FIG. 4 is a diagram showing the relationship between the depth $h$ of groove and the heat transfer rate $\alpha$, wherein the depth $h$ is given as an abscissa and the heat transfer rate $\alpha$ of a heat transfer pipe provided with the grooves as against the heat transfer rate $\alpha_o$ of a smooth pipe is given as an ordinate.

The conditions of this experiment were as follows:

| | |
|---|---|
| Material of the heat transfer pipe | Copper |
| Inner diameter d of the heat transfer pipe | 11.2 mm |
| Depth h of the groove | gradually varied from 0.02 mm |
| Pitch p of the groove | 0.5 |
| Inclination $\beta$ of the groove | 45° |
| Apex angle $\gamma$ of the groove | 60° |
| Refrigerant used | R-22 |
| Pressure of the boiling liquid | 4 kg/cm$^2$G |
| Flow rate (weight) Gr of the boiling liquid | 60 kg/hr |
| Heat flux q applied | 500 Kcal/m$^2$hr |
| Average mass vapor quality $\bar{x}$ | 0.6 |

As apparent from FIG. 4, the heat transfer pipe provided in the inner wall surface thereof with the grooves 2 shows a high heat transfer rate, when the depth $h$ of the groove 2 ranges from 0.02 to 0.2 mm, said rate reaching three times as high as that of the smooth pipe at its maximum. Such a high heat transfer rate can be attributed to the fact that when the groove 2 has the values of 0.02 to 0.2 mm in depth $h$ and of 0.1 to 0.5 mm in pitch $p$, a boiling fluid passing through the heat transfer pipe 1 receives a rotating force along the pipe wall, and flows in a manner that said boiling fluid forms a thin film which almost adheres to the entire area of inner wall surface of heat transfer pipe 1 due to capillarity, with the gaseous portion of the boiling fluid flows through the central portion of heat transfer pipe 1. Furthermore, the grooves 2 serve as the centers of boiling since the grooves are are so fine in size.

Figure 5:
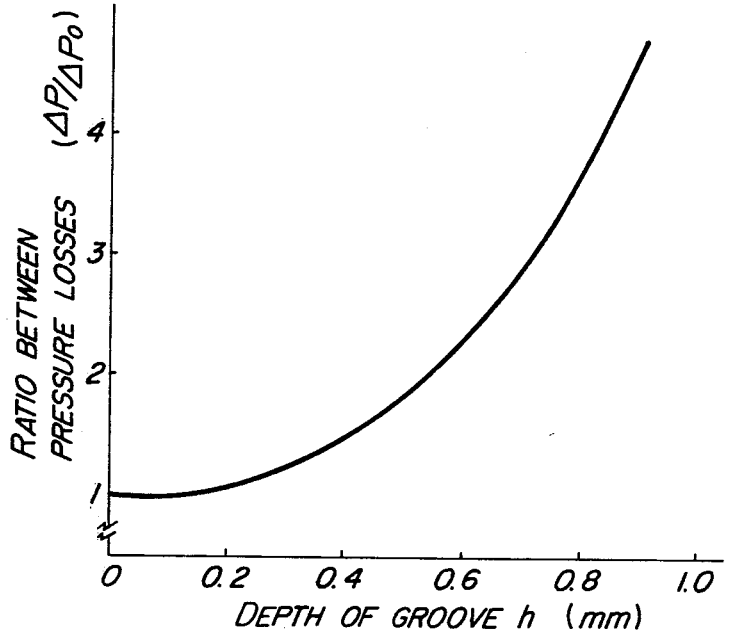
FIG. 5 is a diagram showing the relationship between the depth of groove and the ratio of pressure losses.

FIG. 5 is a diagram showing the relationship between the depth $h$ of groove 2 and the pressure loss $\Delta P$, wherein the depth $h$ is given as an abscissa and the ratio between the pressure loss $\Delta P$ of heat transfer pipe provided therein with the grooves 2 and the pressure loss $\Delta P_o$ of smooth pipe ($\Delta P/\Delta P_o$) is given as an ordinate.

The measurements of the pressure losses were made in parallel with the measurement of the aforesaid heat transfer rate $\alpha$ under the conditions identical with the preceding embodiment.

As apparent from FIG. 5, the pressure loss is increased with increase of the depth $h$ of the groove 2 in the manner of a curve of the second order. When the depth $h$ of groove 2 is less than 0.2 mm, the pressure loss of a heat transfer pipe provided therein with grooves is substantially equal to that of smooth pipe. In that case, the provision of grooves 2 hardly contributes to the increase in pressure loss.

The equality of pressure losses between the heat transfer pipe provided with the grooves 2 having a depth $h$ less than 0.2 mm and the smooth pipe can be attributed to the fact that when the boiling fluid flows in a manner that the liquid is adhering to the inner wall surface of heat transfer pipe 1, said liquid covers and renders smoothness to the grooves 2, and forms a free interface having less resistance than that the solid wall has in the case of the conventional heat transfer pipe provided therein with deep grooves.

Figure 6:
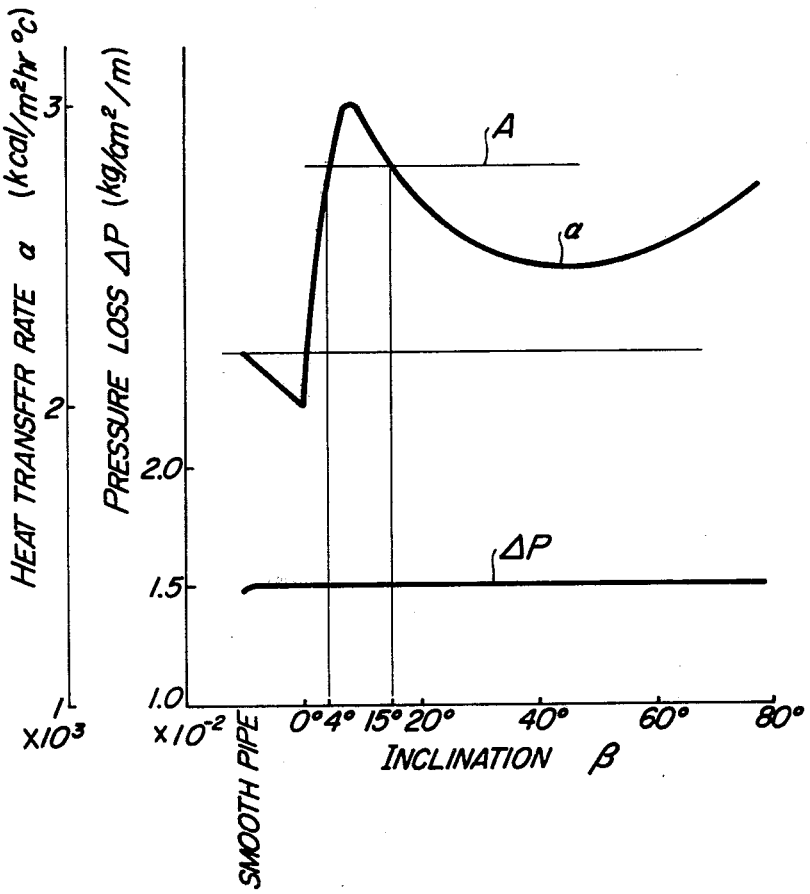
FIG. 6 is a diagram showing the relationship between the inclination of groove and the heat transfer rate and the relationship between the inclination of groove and the pressure loss.

FIG. 6 is a diagram showing the relationship between the inclination $\beta$ of groove 2 and the heat transfer rate $\alpha$, wherein the inclination $\beta$ of groove 2 is given as an abscissa and the heat transfer rate $\alpha$ is given as an ordinate.

As the criterion in comparison, the heat transfer rate of smooth pipe is shown to the left in the drawing. Additionally, the conditions of this experiment were as follows:

| | |
|---|---|
| Material of the heat transfer pipe | Aluminum |
| Inner diameter d of the heat transfer pipe | 11.2 mm |
| Depth h of the groove | 0.15 mm |
| Pitch p of the groove | 0.5 mm |
| Inclination $\beta$ of the groove | gradually varied from 0° |
| Apex angle $\gamma$ of the groove | 90° |
| Refrigerant used | R-22 |
| Pressure of the boiling liquid | 4 kg/cm²G |
| Flow rate (weight) Gr of the boiling liquid | 43 kg/hr |
| Heat flux q applied | 18,300 Kcal/m²hr |
| Average mass vapor quality $\bar{x}$ | 0.6 |

Apparent from FIG. 6, the pressure loss $\Delta P$ is hardly affected by the inclination $\beta$ of groove 2 and substantially constant. The heat transfer rate $\alpha$ is greatly varied by the inclination $\beta$ of groove 2. When the inclination $\beta = 0°$, i.e., the grooves 2 are parallel to the axis 3 of the heat transfer pipe 1, a value lower than that of smooth pipe is indicated, and the rise becomes sharper with increase of the inclination $\beta$. The maximum value is reached in the vicinity of the inclination $\beta$ being 7°. The value decreases with rise of the inclination $\beta$ from 7°, and gradually increases with rise of the inclination $\beta$ from approx. 45°.

Then, the provision of grooves 2 on the inner wall surface of heat transfer pipe 1 increases area of the inner surface which is concerned with heat transmission of the heat transfer pipe by approx. 35%, and little effect is found due to the difference of the inclination $\beta$ of groove 2 in degree.

As described above, when area of the inner surface is increased, naturally the heat transfer rate is improved. Now, if assumption is made that all the increased surface area is uniformly concerned with heat transmission, then the heat transfer rate is risen by 35% and can be indicated by a straight line A. Therefore, the inclination $\beta$ indicating a heat transfer rate higher than the value indicated by the straight line A is included within the range from 4° to 15°, which can be called the preferable range of inclination.

Said inclination range from 4° to 15° is regarded as the inclination range which is effective in rendering a large rotating force to the boiling liquid through the agency of the gas flowing through the central portion of heat transfer pipe, thereby lifting the boiling liquid liable to gather in the lower portion of heat transfer pipe.

Figure 7:
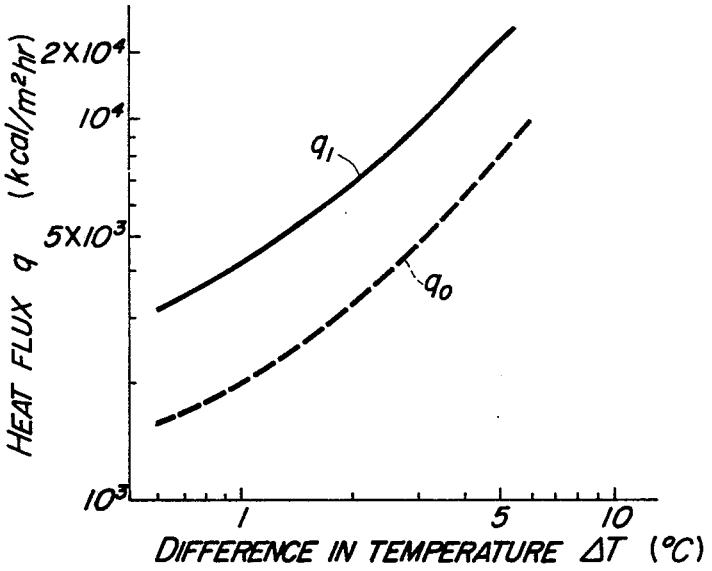
FIG. 7 is a diagram showing the relationship between the difference in temperature and the heat flux.

FIG. 7 shows the relationship between the heat flux $q$ (Kcal/m²hr) and the difference in temperature $\Delta T$ (° C) (The difference in temperature means the difference between the temperature of pipe wall of heat transfer pipe 1 and the saturation temperature of boiling liquid.), wherein the difference in temperature $\Delta T$ (° C) is given as an abscissa and the heat flux $q$ (Kcal/m²hr) is given as an ordinate.

A curve $q_1$ indicates the heat flux of heat transfer pipe according to the present invention and $q_o$ the heat flux of smooth pipe. The conditions of this experiment were as follows:

| | |
|---|---|
| Material of the heat transfer pipe | Copper |
| Inner diameter d of the heat transfer pipe | 11.2 mm |
| Depth h of the groove | 0.1 mm |
| Pitch p of the groove | 0.5 mm |
| Inclination $\beta$ of the groove | 45° |
| Apex angle $\gamma$ of the groove | 60° |
| Refrigerant used | R-22 |
| Pressure of the boiling liquid | 4 kg/cm²G |
| Flow rate (weight) Gr of the boiling liquid | 43 kg/hr |
| Average mass vapor quality $\bar{x}$ | 0.6 |

Figure 8:
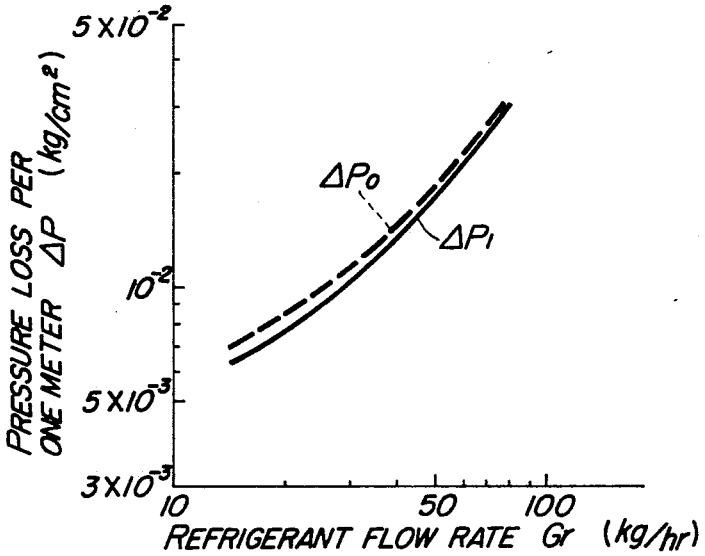
FIG. 8 is a diagram showing the relationship between the flow rate of refrigerant and the pressure loss.

As apparent from FIG. 7, it is found that the heat transfer pipe according to the present invention has the heat flux superior to that of the smooth pipe over all range of differences in temperature. FIG. 8 is a diagram showing the relationship between the refrigerant flow rate Gr (kg/hr) and the pressure loss $\Delta P$ (kg/cm²) per meter of heat transfer pipe, wherein the refrigerant flow rate Gr (kg/hr) is given as an abscissa and the pressure loss $\Delta P$ (kg/cm²) is given as an ordinate. A curve $\Delta P_1$ indicates the pressure loss of heat transfer pipe 1 according to the present invention and a curve $\Delta P_o$ the pressure loss of smooth pipe. The conditions of this experiment were as follows:

| | |
|---|---|
| Material of the heat transfer pipe | Copper |
| Inner diameter d of the heat transfer pipe | 11.2 mm |
| Depth h of the groove | 0.1 mm |
| Pitch p of the groove | 0.5 mm |
| Inclination $\beta$ of the groove | 45° |
| Apex angle $\gamma$ of the groove | 60° |
| Refrigerant used | R-22 |
| Pressure of the boiling liquid | 4 kg/cm²G |
| Flow rate (weight) of the boiling | |

-continued

| | |
|---|---|
| liquid Gr | 43 kg/hr |
| Heat flux q applied | 12,000 Kcal/m²hr |
| Average mass vapor quality $\bar{x}$ | 0.6 |

As apparent from said FIG. 8, it is found that the heat transfer pipe according to the present invention has the pressure loss somewhat lower than the smooth pipe over all range of the flow rates of refrigerant flowing through the heat transfer pipe.

Figure 9:
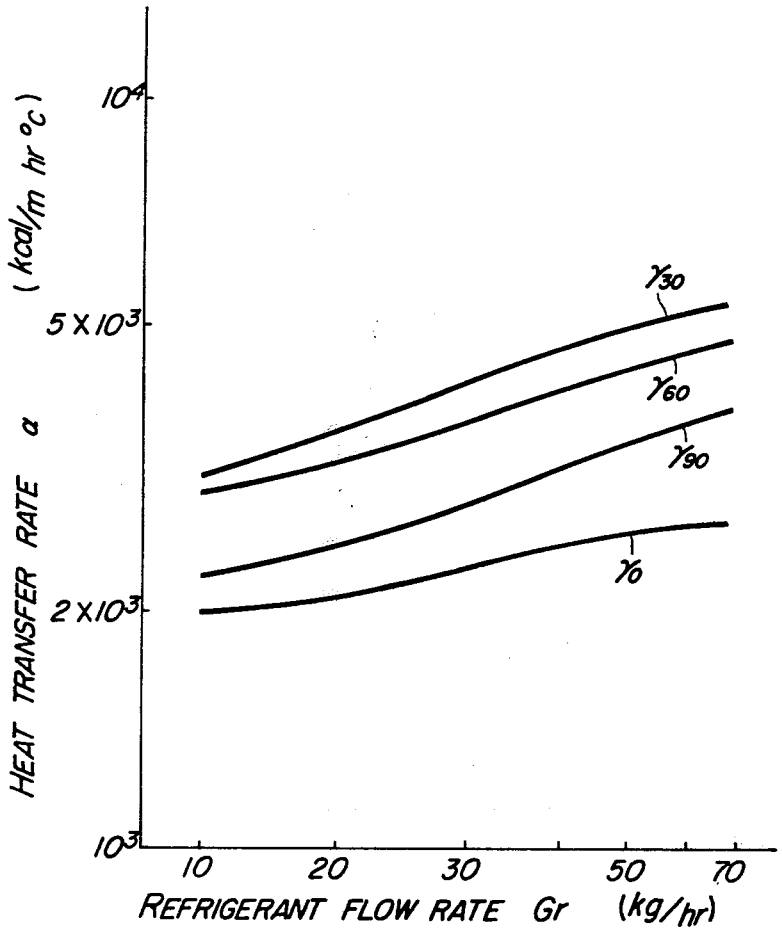
FIG. 9 is a diagram showing the relationship between the apex angle of groove which is V-shaped in section and the heat transfer rate.

FIG. 9 is a diagram showing the relationship between the variation of apex angle of groove 2 and the heat transfer rate $\alpha$ in the case of the grooves 2 being V-shaped in section, wherein the refrigerant flow rate Gr (kg/hr) is given as an abscissa and the heat transfer rate $\alpha$ (Kcal/m²hr° C) is given as an ordinate. Referring to said FIG. 9, a curve $\gamma_{30}$ indicates the case where the apex angle $\gamma$ is 30°, a curve $\gamma_{60}$ the case where the apex angle $\gamma$ is 60°, a curve $\gamma_{90}$ the case where the apex angle $\gamma$ is 90°, and a curve $\gamma_o$ the case of smooth pipe used. The conditions of the experiment were as follows:

| | |
|---|---|
| Material of the heat transfer pipe | Copper |
| Inner diameter d of the heat transfer pipe | 11.2 mm |
| Depth h of the groove | 0.2 mm |
| Pitch p of the groove | 0.5 mm |
| Inclination $\beta$ of the groove | 84° |
| Refrigerant used | R-22 |
| Pressure of the boiling liquid | 4 kg/cm²G |
| Heat flux q applied | 18,000 Kcal/m²hr |
| Average mass vapor quality $\bar{x}$ | 0.6 |

Figure 10:
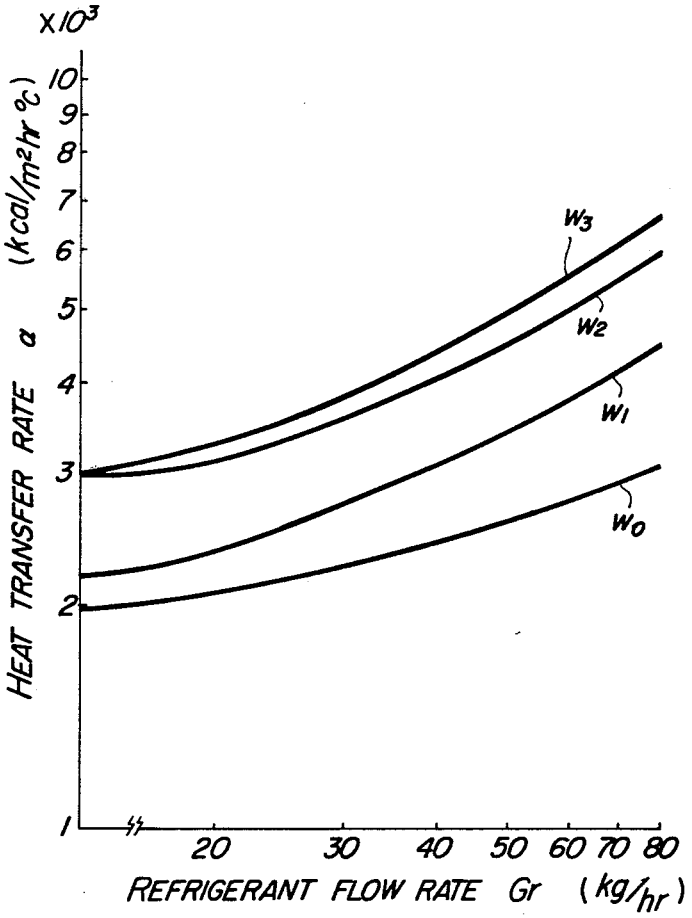
FIG. 10 is a diagram showing the relationship between the width of groove which is U-shaped in section and the heat transfer rate.

As apparent from said FIG. 9, when the grooves 2 are V-shaped in section, there is indicated that the sharper the apex angle is, the higher the heat transfer rate is obtained. FIG. 10 is a diagram showing the variation of the heat transfer rate $\alpha$ (Kcal/m²hr° C) in accordance with the variation of the width $w$ of groove 2 in the case of the grooves 2 being U-shaped in section, wherein the refrigerant flow rate Gr (kg/hr) is given an abscissa and the heat transfer rate $\alpha$ (Kcal/m²hr° C) is given as an ordinate.

A curve $W_o$ indicates the heat transfer rate in the case of smooth pipe used, a curve $W_1$ that in the case of the width $w$ of groove 2 being approx. 0.9 mm, a curve $W_2$ that in the case of the width $w$ of groove 2 being approx. 0.5 mm, and a curve $W_3$ that in the case the width $w$ of groove 2 being approx. 0.25 mm. The condition of this experiment were as follows:

| | |
|---|---|
| Material of the heat transfer pipe | Copper |
| Inner diameter d of the heat transfer pipe | 11.2 mm |
| Depth h of the groove | 0.2 mm |
| Inclination $\beta$ of the groove | 84° |

-continued

| | |
|---|---|
| Refrigerant used | R-22 |
| Pressure of the boiling liquid | 4 kg/cm²G |
| Heat flux q applied | 18,000 Kcal/m²hr |
| Average mass vapor quality $\bar{x}$ | 0.6 |

As apparent from said FIG. 10, when the grooves 2 are U-shaped in section, the narrower the width $w$ of groove 2 are, i.e., the smaller the pitch $p$ of groove 2 are, the higher the heat transfer rate can be obtained.

What is claimed is:

1. In a heat transfer pipe for forced convection boiling or condensing the improvement comprising said heat transfer pipe being formed on its inner wall surface with grooves having a depth from the wall surface to their bottoms in the range between 0.02 and 0.2 millimeters, a pitch between the adjacent grooves in the range between 0.1 and 0.5 millimeters, and an angle of inclination with respect to the axis of the heat transfer pipe arranged between 4° and 15° or 165° and 176°.

2. A heat transfer pipe as claimed in claim 1, wherein the angle of inclination of said grooves with respect to the axis of the heat transfer pipe is 7°.

3. A heat transfer pipe as defined in claim 1, wherein the grooves narrow from the inner wall surface to their bottoms.

4. A heat transfer pipe as defined in claim 3, wherein the grooves are V-shaped in section.

5. A heat transfer pipe as defined in claim 4, wherein the apex angle of groove is no more than 90°.

6. A heat transfer pipe as defined in claim 4, wherein the apex angle of groove ranges from 30° to 60°.

7. A heat transfer pipe as defined in claim 1, wherein the grooves are U-shaped in section.

8. A heat transfer pipe as defined in claim 7, wherein the ratio between the depth and the width of groove is 0.4 at minimum.

9. A heat transfer pipe as defined in claim 7, wherein the ratio between the depth and the width of groove is 4.0 at maximum.

10. A heat transfer pipe adapted for use in a heat exchanger of an air conditioner, freezer, air separator, etc., which heat transfer pipe has an inner diameter in the range between 5 and 20 millimeters and is adapted to permit a boiling liquid or a condensing liquid to flow therethrough, said heat transfer pipe being formed on its inner wall surface with grooves having a depth from the wall surface to their bottoms in the range between 0.02 and 0.2 millimeters, a pitch between the adjacent grooves in the range between 0.1 and 0.5 millimeters, and an angle of inclination with respect to the axis of the heat transfer pipe in the range between 4° and 15° or 165° and 176°.

11. A heat transfer pipe as claimed in claim 9, wherein the angle of inclination of said grooves with respect to the axis of the heat transfer pipe is 7°.

* * * * *